United States Patent [19]

Bschorr et al.

[11] 4,325,458

[45] Apr. 20, 1982

[54] APPARATUS FOR REDUCING THE EXHAUST NOISE OF INTERNAL COMBUSTION ENGINES OR THE LIKE

[75] Inventors: Oskar Bschorr, Munich; Eckehard Laudien, Holzkirchen, both of Fed. Rep. of Germany

[73] Assignee: Messerschmitt-Boelkow-Blohm Gesellschaft mit beschraenkter Haftung, Munich, Fed. Rep. of Germany

[21] Appl. No.: 207,088

[22] Filed: Nov. 14, 1980

[30] Foreign Application Priority Data

Nov. 23, 1979 [DE] Fed. Rep. of Germany ..... 2947256

[51] Int. Cl.[3] ..... F01N 7/08; F01N 1/02; F01N 1/24

[52] U.S. Cl. ..... 181/227; 181/249; 181/256

[58] Field of Search ..... 181/227, 228, 247–249, 181/251, 255–258, 222, 252

[56] References Cited

U.S. PATENT DOCUMENTS 4,104,426 8/1978 Gonzales et al. ..... 181/227 X
4,149,612 4/1979 Bschorr ..... 181/286
4,228,869 10/1980 Bschorr ..... 181/286

FOREIGN PATENT DOCUMENTS 2632290 6/1979 Fed. Rep. of Germany ..... 181/288
2834823 10/1979 Fed. Rep. of Germany ..... 181/286

*Primary Examiner*—L. T. Hix
*Assistant Examiner*—Thomas H. Tarcza
*Attorney, Agent, or Firm*—W. G. Fasse; D. H. Kane, Jr.; D. F. Gould

[57] ABSTRACT

The noise of an exhaust gas flow of an internal combustion engine or other thermodynamic equipment is reduced by silators which are operatively arranged for deadening or absorbing the exhaust noise. Such silators have vaulted surfaces enclosing an evacuated volume which may include a cooling liquid. The silators have a resonance frequency that depends on the vaulting height and the free span or diameter of the vaulted surface. By properly dimensioning the silators and combining a plurality thereof each having a different resonance frequency, a wide frequency range of exhaust noises may be covered. Preferably the silator impedance is smaller than the air impedance of the environment. The silators are protected against the heat of the exhaust gases.

15 Claims, 7 Drawing Figures

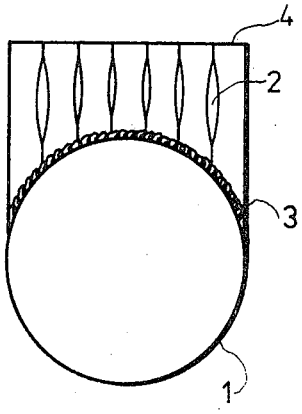
Fig. 1b
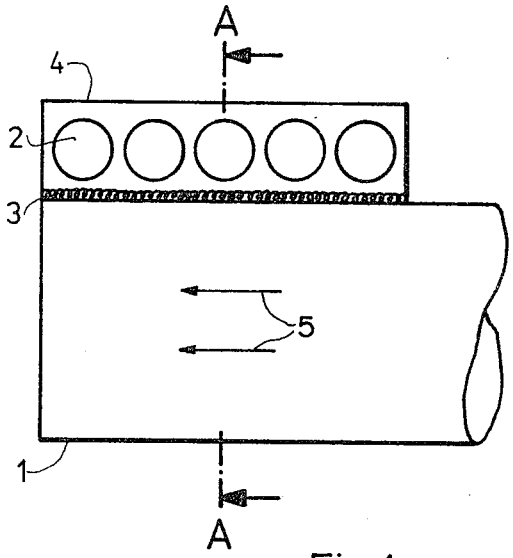
Fig. 1a
Fig. 2
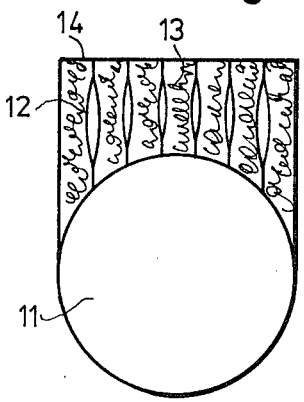
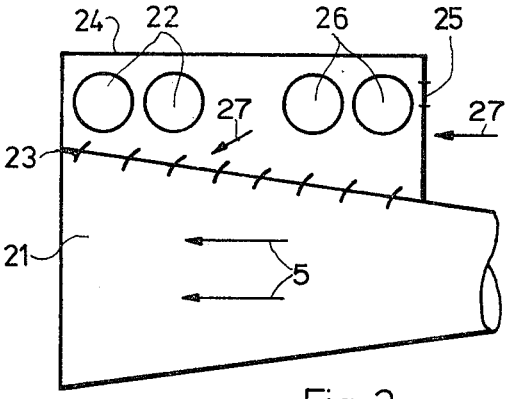
Fig. 3
Fig. 4
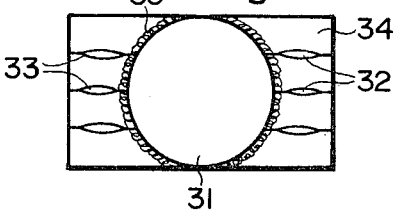
Fig. 5
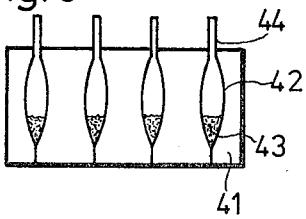
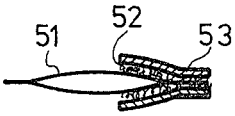
Fig. 6

APPARATUS FOR REDUCING THE EXHAUST NOISE OF INTERNAL COMBUSTION ENGINES OR THE LIKE

CROSS-REFERENCE TO RELATED APPLICATION

The present application corresponds to German patent application No. 2,947,256.8-13, filed in the Federal Republic of Germany on Nov. 23, 1979. The priority of said German filing data is hereby claimed.

BACKGROUND OF THE INVENTION

The present invention relates to an apparatus for reducing the exhaust noise of internal combustion engines, thermodynamic equipment, and similar devices by means of so-called silators.

U.S. Pat. No. 4,149,612, issued Apr. 17, 1979, is based on German Pat. No. 2,632,290 and generally describes the construction details of silators. Basically, a silator comprises an evacuated volume enclosed between two relatively flexible, vaulted walls. The resonance frequency of such silators depends on the dimensions such as the diameter and the vaulting height.

So-called mufflers have been suggested heretofore in many variations for the damping or deadening of the exhaust noise of internal combustion engines and the like. All prior art mufflers are based on the same relatively few basic principles employing primarily noise absorption systems including materials with open pores. Other prior art systems achieve a noise insulation by means of resonating volumes including impedance breaks which are tuned relative to each other with regard to the resonance frequencies or the frequencies at which the impedance break takes place. All prior art devices require a relatively large structure. Besides, prior art mufflers are subject to very strong corrosion effects as well as to chemical conversion of the absorption materials.

OBJECTS OF THE INVENTION

In view of the above it is the aim of the invention to achieve the following objects singly or in combination:

to construct a muffler type apparatus which has a relatively small structure as compared to the volume of prior art mufflers, while simultaneously increasing the muffler effect or its noise deadening effect;

to construct a muffler which is effective over a wide range of noise frequencies;

to cover a muffler at least partially with anti-noise or anti-humming coating means; and to provide means for cooling a muffler for prolonging its effective life.

SUMMARY OF THE INVENTION

According to the invention there is provided a muffler structure in which the exhaust pipe is provided with a plurality of so-called silators tuned to different frequencies and having an impedance related to the impedance of the surrounding air. Preferably the silator impedance is smaller than the air impedance. Further, the silator is protected against the hot and agressive exhaust gas jet by means of a protective layer such as a perforated sheet metal, metal wool, or the like, or by providing the inner volume of the silator with a high boiling liquid, preferably in combination with cooling fins.

The silators which vibrate as resonators with the noise frequencies to which the individual silators are tuned, and which are integrated into the exhaust pipe channel, cause an impedance break in the area of the resonance frequency, thereby in turn causing a reflection. By using a plurality of silators tuned to different frequencies, a broad noise frequency range may be deadened or insulated. Further, if the silators are provided at least partially with noise damping material such material also, due to its resistance, absorbs noise or sound and the combined effect is then based on noise absorption as well as on noise deadening or insulating. In order to reduce the vibrating mass, it is advantageous to cover only the edges of the silators with the anti-noise or anti-hum coating. The present silators may also be combined with so-called counter leaflets or lamella.

BRIEF FIGURE DESCRIPTION

In order that the invention may be clearly understood, it will now be described, by way of example, with reference to the accompanying drawings, wherein:

FIG. 1*a* is a schematic, longitudinal sectional view through the discharge end of an exhaust pipe;

FIG. 1*b* is a sectional view along section line A—A in FIG. 1*a;*

FIG. 2 is a sectional view similar to that of FIG. 1*b*, however, showing absorption means combined with the silators;

FIG. 3 is a sectional view through a divergent exhaust pipe end combined with silators and a cooling system for the silators;

FIG. 4 is a sectional view through a muffler arrangement with the silators positioned on opposite sides of the exhaust pipe;

FIG. 5 is a schematic view illustrating the silators arranged inside the exhaust pipe and provided with a so-called heat pipe cooling for the silators; and FIG. 6 is a sectional view through a silator provided with damping means.

DETAILED DESCRIPTION OF PREFERRED EXAMPLE EMBODIMENTS AND OF THE BEST MODE OF THE INVENTION

FIGS. 1*a* and 1*b* show in a somewhat simplified illustration sectional views through an exhaust pipe 1 equipped, according to the invention, with silators 2 arranged in a housing or frame 4 and protected against the heat of the exhaust gases 5 by an intermediate protective layer 3, for example, of steel wool or the like. The housing or frame 4 holds several rows of silators 2 preferably arranged in parallel to each other. Preferably, the silators of smaller volume are arranged centrally in the housing or frame while silators of larger volume or of increasing volume are arranged outwardly from a central row of silators as shown in FIGS. 1*b*, 2 and 4.

The silators 2 will have lentil shaped volumes enclosed by sheet metal or the like and the volumes will be of different sizes as illustrated to provide different resonance frequencies for the individual silators. For example, the silators may be made of heat resistant steel sheet metal. More details of the construction of such silators are disclosed in German Pat. (DE-OS) No. 2,632,290 as mentioned above. Such silator elements have pronounced resonance frequencies with impedances smaller than the noise impedance of the surrounding air. Thus, an impedance break or jump is accomplished resulting in an effective noise insulation. In order to achieve the noise insulation over a wide frequency range the individual silators are tuned to individual resonance frequencies. Incidentally, instead of the metal wool 3 forming a protective layer, other protection means against the heat in the pipe 1 may also be used, for example, perforated sheet metal or the like.

FIG. 2 shows an embodiment similar to that of FIG. 1, however, in FIG. 2 the protective housing 14 in which the silators 12 are held is completely filled, except for the silators 12, by a noise passing material 13 such as metal wool which simultaneously provides the heat protection for the silators as described with reference to FIG. 1. The housing 14 is operatively connected to the exhaust pipe 11, for example, by welding or the like.

FIG. 3 shows a longitudinal section through a divergent exhaust pipe end 21, whereby the diameter of the exhaust pipe increases toward the exit end as viewed in the flow direction of the exhaust gases 5. The exhaust pipe 21 is provided with flow apertures 23 providing communication between the exhaust pipe 21 and the protective housing 24 in which groups of silators 22 and 26 are arranged. The first group of silators 22 closer to the exit end of the exhaust pipe are so dimensioned that they have an impedance smaller than the air impedance. The second group of silators 26 are so dimensioned that they have an impedance corresponding approximately to that of the surrounding air. This feature assures an optimal noise absorption. The upstream end of the housing 24 is provided with at least one aperture 25 for the entrance of a cooling medium such as air which is moved through the housing 24 due to the holes 23 in the exhaust pipe 21 where the latter communicates with the housing 24. These holes 23 provide for a Bernoulli type of reduced pressure due to the divergent shape of the exhaust pipe 21, whereby cooling air is sucked through the holes 23 and 25, thereby flowing past the silators 22 and 26 for an effective cooling thereof. The arrows 27 indicate the flow of the cooling air.

FIG. 4 shows an embodiment in which the silators 32 are arranged on one side of the exhaust pipe 31 while the silators 33 are arranged on the opposite side of the pipe 31. Both silator groups 31 and 32 are operatively held in a housing 34 and protected against the heat of the exhaust gases by a protective layer 35 such as steel wool or the like. The material of the layer 35 is permeable to the noise to be deadened by the silators 32, 33. In the embodiment of FIG. 5 the silators 42 are operatively arranged inside the exhaust pipe 41. In order to protect the silators 42 against the heat of the exhaust gases, the volumes confined by the walls of the silators and which are normally evacuated, are partially filled with a high boiling liquid 43 such as a fluorine compound. Additionally, the silators 42 are provided with cooling fins 44 extending out of the exhaust pipe 41 and preferably hollow for an effective cooling of the inner volume of the silator since the hollow volume of the cooling fins 44 is operatively connected to the volume inside the silators 42 in the exhaust pipe 41. Thus, when the high boiling liquid 43 evaporates due to the presence of the exhaust gas flow it will condense again on the inner surfaces of the cooling fins 44. Thus, it is possible to keep the thermal loading of the silators within permissible limits.

FIG. 6 shows an embodiment in which the silators 51 are covered at least partially with an anti-noise or anti-hum coating 52 of a suitable damping material which is wedged in between the edges of the silator 51 and a sheet metal frame 53 adapted to the contours of the silators. In order not to noticeably increase the vibrating mass of the silators 51 the damping material 52 and the frame 53 are preferably located only around the edges of the silators 51. Due to this damping material the silators also absorb noise due to the resistance of the damping material.

Although the invention has been described with reference to specific example embodiments, it will be appreciated, that it is intended to cover all modifications and equivalents within the scope of the appended claims.

What is claimed is:

1. An apparatus for reducing the noise of an exhaust gas flow comprising exhaust pipe means, frame or housing means, a plurality of silator means tuned to different frequencies operatively held in rows in said frame or housing means, connecting means operatively securing said frame or housing means to said exhaust pipe means so as to transmit the noise of the exhaust gas flow to the silator means, and heat protection means operatively associated with said silator means for protecting said silator means from any hot exhaust gas, said silator means having a noise impedance selected relative to the noise impedance of the air of the surrounding environment.

2. The apparatus of claim 1, wherein said noise impedance of said silator means is smaller than the noise impedance of the environment air.

3. The apparatus of claim 1, wherein said silator means comprise first silator members located adjacent to the exit end of said exhaust pipe means, said first silator members having a noise impedance smaller than the noise impedance of the environment, and further silator members located upstream along the exhaust pipe means as viewed in the flow direction of said exhaust flow, said further silator members having a noise impedance approximately equal to the noise impedance of the environment air.

4. The apparatus of claim 1, wherein said heat protection means comprise a porous, noise permeable, heat resistant material operatively interposed between said exhaust pipe means and said silator means.

5. The apparatus of claim 1, wherein said heat protection means comprise a perforated, noise permeable sheet metal operatively interposed between said exhaust pipe means and said silator means.

6. The apparatus of claim 5, wherein said exhaust gas pipe means comprise a divergent shape with the diameter increasing in the flow direction, said divergent shape causing a reduced pressure suction effect through the perforations of said perforated sheet metal, housing means operatively arranged relative to said perforations in said perforated sheet metal so that the interior of said housing means communicates with said perforations, said silator means being arranged in said housing means, and air entrance openings in said housing means so located that a cooling flow along said silators is caused by said suction effect.

7. The apparatus of claim 1, wherein said heat protection means for said silator means comprise a cooling liquid having a high boiling point operatively located inside said silator means, said silator means further comprising cooling fin means for enhancing the cooling effect of said cooling liquid.

8. The apparatus of claim 7, wherein said silator means are located inside said exhaust pipe means, and wherein said cooling fin means extend outside said exhaust pipe means.

9. The apparatus of claim 8, wherein said cooling fin means are hollow.

10. The apparatus of claim 1, further comprising anti-noise cover means covering at least the edges of said silator means, said anti-noise cover means being arranged between said frame or housing means and said silator means.

11. The apparatus of claim 1, wherein said rows of silators in said frame or housing means are arranged substantially in parallel relative to each other, said silators having different volumes in different rows whereby silators of smaller volume are arranged in centrally located rows whereas silators or larger volume are located further outwardly in said frame or housing.

12. An apparatus for reducing the noise of an exhaust gas flow comprising exhaust pipe means, a plurality of silator means tuned to different frequencies operatively connected to said exhaust pipe means, heat protection means operatively associated with said silator means for protecting said silator means from any hot exhaust gas, said silator means having a noise impedance selected relative to the noise impedance of the environment, said heat protection means comprising a perforated sheet metal operatively interposed between said exhaust pipe means and said silator means, said exhaust gas pipe means comprising a divergent shape with the diameter increasing in the flow direction, said divergent shape causing a reduced pressure suction effect through the perforations of said perforated sheet metal, housing means operatively arranged relative to said perforations in said perforated sheet metal so that the interior of said housing means communicates with said perforations, said silator means being arranged in said housing means, and air entrance openings in said housing means so located that a cooling flow along said silators is caused by said suction effect.

13. An apparatus for reducing the noise of an exhaust gas flow comprising exhaust pipe means, a plurality of silator means tuned to different frequencies operatively connected to said exhaust pipe means, heat protection means operatively associated with said silator means for protecting said silator means from any hot exhaust gas, said silator means having a noise impedance selected relative to the noise impedance of the environment, said heat protection means for said silator means comprising a cooling liquid having a high boiling point operatively located inside said silator means, and wherein said silator means further comprise cooling fin means for enhancing the cooling effect of said cooling liquid.

14. The apparatus of claim 13, wherein said silator means are located inside said exhaust pipe means, and wherein said cooling fin means extend outside said exhaust pipe means.

15. The apparatus of claim 13, wherein said cooling fin means are hollow.

* * * * *

UNITED STATES PATENT OFFICE

CERTIFICATE OF CORRECTION

Patent No. 4,325,458 Dated April 20, 1982

Inventor(s) Oskar Bschorr et al

It is certified that error appears in the above-identified patent and that said Letters Patent are hereby corrected as shown below:

In Claim 3, line 5, (column 4, line 34) after "environment" insert --air--.

In Claim 11, line 6, replace "or" by --of-- (column 5, line 15).

Signed and Sealed this

Twenty-second Day of June 1982

[SEAL]

Attest:

GERALD J. MOSSINGHOFF

Attesting Officer

Commissioner of Patents and Trademarks